United States Patent [19]

Yamamoto

[11] 4,167,168

[45] Sep. 11, 1979

[54] FUEL INJECTION APPARATUS

[75] Inventor: Yoshihisa Yamamoto, Kariya, Japan

[73] Assignee: Nippondenso Co., Ltd., Kariya, Japan

[21] Appl. No.: 762,168

[22] Filed: Jan. 24, 1977

[30] Foreign Application Priority Data

Feb. 5, 1976 [JP] Japan ..... 51-11712
Feb. 27, 1976 [JP] Japan ..... 51-21318

[51] Int. Cl.[2] ..... F02M 39/00
[52] U.S. Cl. ..... 123/139 AT
[58] Field of Search .... 123/139 R, 139 AT, 139 AK, 123/139 BF, 139 DP; 239/584, 533.8, 533.9

[56] References Cited

U.S. PATENT DOCUMENTS 3,810,453 5/1974 Wolfe ..... 123/139 R
4,036,192 7/1977 Nakayama ..... 123/139 AT

*Primary Examiner*—Charles T. Jordan
*Attorney, Agent, or Firm*—Cushman, Darby & Cushman

[57] ABSTRACT

A fuel injection apparatus for an internal combustion engine comprises a fuel feeding device for feeding intermittently a high pressure fuel to a fuel injection valve apparatus for injecting fuel to the engine. The fuel injection valve apparatus comprises a valve housing formed with a fuel chamber and an injection orifice, and a needle valve element slidably disposed within the valve housing for opening and closing the injection nozzle orifice. The injection orifice is opened by the high pressure fuel supplied from the fuel feeding apparatus, and is closed by a biasing means such as a spring in association with a hydraulic thrusting means which accumulates the high pressure fuel to thrust the needle valve element toward the injection orifice closing position thereby to accomplish a rapid termination of the fuel injection. The fuel feeding apparatus comprises a cylinder and a plunger. The cylinder has a feed hole , while the plunger has a notch having a straight leading edge. At the end of the fuel feeding stroke of the plunger, the feed hole is communicated with the plunger chamber through the notch with the feed hole, whereby the fuel within the plunger chamber returns to a fuel supply. Thus, the fuel pressure counteracting the injection orifice closing operation is abruptly decreased to allow a rapid termination of the fuel injection.

16 Claims, 5 Drawing Figures

FUEL INJECTION APPARATUS

Figure 1:
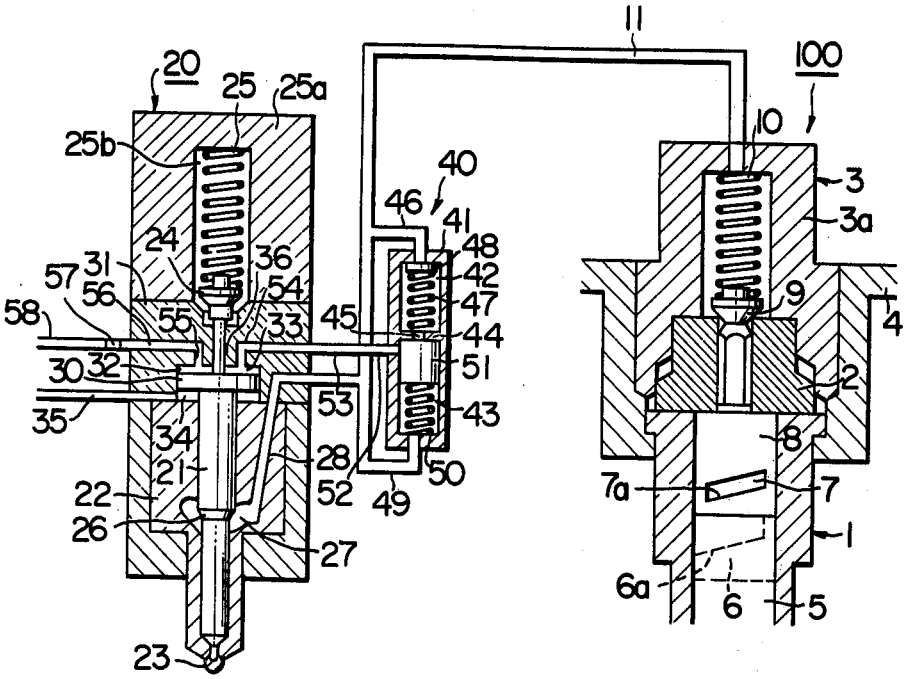

The present invention relates to a fuel injection apparatus for internal combustion engines, and particular to a fuel injection apparatus of the type wherein a plunger in a cylinder intermittently feeds a fuel under a pressure to a fuel injection nozzle valve having a needle valve element which is actuated by the fuel pressure against a bias spring so as to feed the fuel through a nozzle valve into the associated cylinder of an internal combustion engine, and of the type wherein the fuel injection is terminated when the plunger comes to a position where its guide groove overlaps a feed hole provided in the wall of the cylinder.

In the fuel injection valve apparatus of the above described type which have been hitherto commonly used in internal combustion engines, the load or force to urge the needle valve element to the orifice closing position against the fuel pressure is attained only by using a valve spring. In other words, the closing of the fuel injection orifices at the end of a fuel injection cycle is effected by the needle valve element which is actuated only by the valve spring urging constantly the valve element toward the orifice closing position. The opening of the nozzle orifices upon the injection of fuel into an associated cylinder of the internal combustion engine is brought about due to the movement of the needle valve element by the high pressure against the bias force of the spring. Accordingly the orifice closing measure exerted onto the needle valve element by the valve spring is determined in consideration of the injection orifice opening pressure and cannot be increased independently of the latter. Besides, since the injection orifice closing force applied to the needle valve element is in general smaller than the orifice opening pressure, the fuel injection may not be terminated rapidly and sharply.

In connection with the hitherto commonly known fuel injection valve apparatus of the structure described above, there is provided a fuel feed apparatus comprising a cylinder formed with a circular feed hole and a plunger formed with a notch, said cylinder and said plunger defining a chamber into which the fuel, to be fed under pressure, is supplied from a fuel supply means through the feed hole at the initial stage of the fuel feeding stroke of the plunger. The fuel under pressure is pumped out from the fuel feed apparatus when the plunger is retracted into the cylinder. The fuel is fed into the fuel injection nozzle valve which in turn injects the fuel into the associated cylinder of an internal combustion engine. The needle valve element which is urged by a spring to the closing position of the fuel injection nozzle valve, is actuated by the fuel pressure so as to inject the fuel. When the plunger is further retracted and comes to a position where the notch and the circular feed hole overlap each other, the chamber is communicated to the fuel supply means through the notch and the feed hole so that the fuel in the chamber is returned to the supply means. Thus, the fuel pressure in the fuel injection nozzle valve is decreased so that the needle valve element is returned to the closing position of the fuel injection nozzle valve under the force of the bias spring.

There is a disadvantage in such a fuel injection valve apparatus described above. It is necessary for purifying exhaust gas of an internal combustion engine that the fuel injection is rapidly and sharply terminated, otherwise an unburnt part of the fuel is discharged from the hitherto associated cylinder of the internal combustion engine. However, the hitherto fuel injection apparatus dose not meet such a requiment, as understood from the above description.

An object of the invention is therefore to provide a fuel injection apparatus which is evaded from the drawbacks of the hitherto known apparatus described above.

Another object of the invention is to provide a fuel injection apparatus which permits a rapid and sharp termination of the fuel injection.

With the above objects in view, there is provided according to the invention a novel and improved fuel injection apparatus for internal combustion engines comprising a fuel feed device for feeding the fuel intermittently under a high pressure to a fuel injection valve device which is adapted to inject the fuel intermittently into an associated combustion chamber. According to one aspect of the invention, the fuel injection valve device comprises a valve housing communicated with the fuel pressure-feeding device and formed with fuel injection orifices, and a needle valve element which is slidably fitted in the valve housing and serves to open and close the fuel injection orifices. The orifice opening operation of the needle valve element is effected by the fuel pressure supplied to the injection valve device, while the orifice closing operation is carried out by a first loading means applying constantly a predetermined force to the needle valve element in the orifice closing direction in coooperation with a second hydraulic loading means operatively coupled to the needle valve element and adapted to exert a hydraulic pressure to the valve element to urge it in the orifice closing direction by utilizing the hydraulic pressure of the fuel itself fed to the injection valve apparatus. With such construction of the injection valve apparatus, a rapid termination of the fuel injection can be accomplished under the combined force of the first and the second loading means.

According to another aspect of the invention, the fuel pressure-feading device comprises a cylinder formed with a feed hole and a plunger reciprocally disposed within the cylinder so as to vary a volume of a plunger chamber defined therebetween. A notch having a straight leading edge is formed in the plunger and opened into the plunger chamber. On the other hand, the feed hole formed in the cylinder through which the fuel is introduced into the plunger chamber at the beginning of the fuel injection cycle, has a straight edge which first comes into alignment with the leading edge of the notch and has the same geometrical configuration as that of the leading edge so that the opened aperture area of the feed hole is increased abruptly at the beginning of the alignment between the notch and the feed hole at the end of the fuel feeding movement of the plunger.

Figure 2:
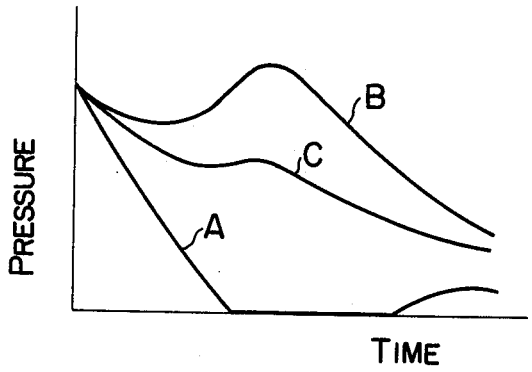
Figure 3:
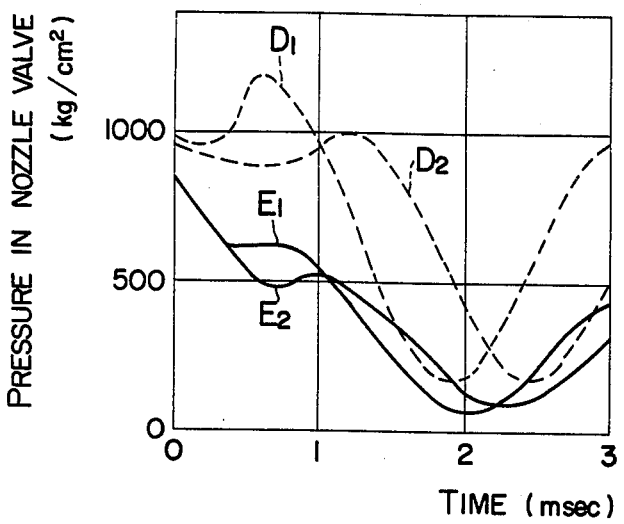
Figure 4:
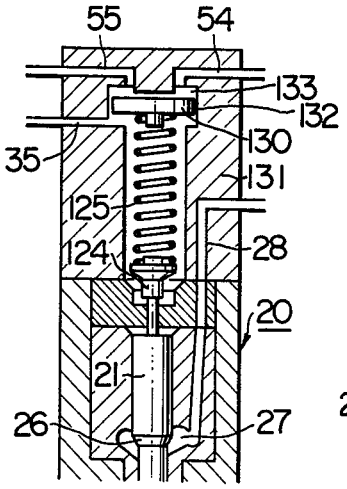
Figure 5:
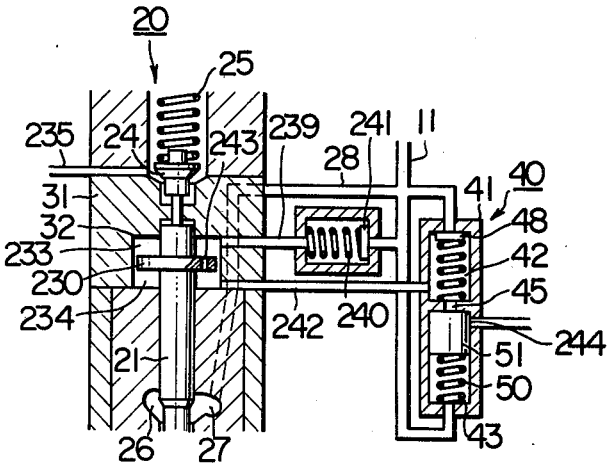

The above and other objects, novel features as well as advantages of the invention will become more apparent from the detailed description of embodiments of the invention taken in conjunction with the accompanying drawings in which;

FIG. 1 shows in sectional view a general arrangement of a fuel injection apparatus according to an embodiment of the present invention, FIG. 2 illustrates graphically fuel pressure variations in a fuel chamber of the fuel injection valve apparatus during the closing operation of fuel injection nozzle orifices by means of a needle valve element, FIG. 3 illustrates graphically fuel pressure variations in the injection valve apparatus according to the invention as compared with those of the hitherto known valve apparatus as measured through experimental simulation, FIG. 4 shows a partially sectional view another embodiment of the fuel injection nozzel valve apparatus according to the invention, and FIG. 5 shows in a partially sectional view still another embodiment of the fuel injection nozzle valve apparatus according to the invention.

Referring to FIG. 1 which shows a fuel injection apparatus according to an embodiment of the invention, reference numeral 100 indicates generally a fuel pressure-feeding device which comprises a feed cylinder 1 with a plunger 5 and a valve 3 including a valve housing 3*a*, a valve element 9 and a valve seat 2. It will be noted that the feed cylinder 1, the valve seat 2 fixedly disposed on the top end of the cylinder 1 and the valve casing 3*a* are held together and supported securely by a stationary mounting frame 4. Disposed snugly and slidably within the cylinder 1 is the reciprocal plunger 5 which is provided with a notch 6 formed in the upper peripheral portion and opened in the top end portion thereof, as schematically indicated by broken lines in the figure. The notch 6 has a straight edge portion 6*a* slanted relative to the axis of the plunger 5 with a predetermined leading angle. On the other hand, the cylinder 1 is formed with an opening 7 of an inclined parallels gramic configuration in a plunger chamber 8 defined between the top end surface of the plunger 5 and the bottom end surface of the valve seat 2. The aperture or feed hole 7 has a straight lower edge 7*a* slanted relative to the longitudinal axis of the plunger 5 with the same angle as the leading edge portion 6*a*. The positional relationship between the feed hole 7 and the notch 6 having the slanted leading edge 6*a* is so selected that they may come into alignment with each other at the end of the effective upward stroke of the plunger 5. In operation, when the plunger 5 is moved downwardly within the cylinder 1, the fuel is introduced into the plunger chamber 8 through the opening or hole 7 from a fuel supply means (not shown), while the upward movement of the plunger 5 causes the fuel to be fed under pressure from the plunger chamber 8 through the valve 3. In this connection, it is to be noted that, when the leading edge portion 6*a* of the plunger 6 is aligned with the lower edge 7*a* of the feed hole 7 at the end of the upward stroke of the plunger 6, the plunger chamber 8 begins to be communicated again with the fuel supply means (not shown) through the aligned feed hole 7 and the notch 6, whereby the fuel in the chamber 8 may overflow or fed back into the fuel supply means. The fuel pressure prevailing within the plunger chamber 8 is thereby decreased.

The valve 3 includes a valve element 9 disposed on the seat 2 under the load of a compression spring 10 so that the valve element 9 is normally in the closing position. However, when the plunger 5 is moved upwardly for the fuel injection, the valve element 9 is displaced away from the seat 2 under the induced pressure of the fuel in the plunger chamber 8, overcoming the load of the spring 10, as a result of which the fuel is fed into a nozzle valve device 20 through the now opened valve 3 and a feed conduit 11. At the end of the effective upward stroke of the plunger 5, the valve element 9 is again closed under the load of the spring 10, since the fuel pressure within the plunger chamber 8 is reduced due to the communication of the chamber 8 with the fuel supply means (not shown) through the aligned hole 7 and notch 6, as described above.

The nozzle valve device 20 includes a needle valve element 21 which is slidably fitted within a valve housing 22 and has a lower tip end which is adapted to open and close nozzle orifices 23 formed in the valve housing 22 at the downwardly protruding end portion thereof. The diameter of the needle valve element 21 is reduced at a substantially lower half portion so as to form a shoulder portion 26 which is positioned in a fuel chamber 27 formed in the valve housing 22. The fuel chamber 27 is communicated with the fuel feed conduit 11 through a feed supply passage 28 formed in the valve housing 22 and a cylinder block 31 which is fixedly disposed on the valve housing 22.

Formed in the cylinder block 31 is a bore 32 in which a piston 30 is slidably disposed in a fluid-tight manner. The piston 30 is fixedly secured to the needle valve element 21 at the top end thereof and defines a pressure chamber 33 in the bore 32 above the upper surface of the piston 30. On the other hand, the lower surface of the piston 30 defines in the cylindrical bore 32 a fuel escape chamber 34 which is adapted to receive the fuel leaking from the fuel chamber 27 during the reciprocating operation of the needle valve element 21 slidably fitted in the valve housing 22. A discharge passage 35 extends outwardly from the chamber 34.

Mounted fixedly on the cylinder block 31 is a spring housing 25*a* in which a spring chamber 25*b* is formed in perpendicular alignment with the needle valve element 21. A compression spring 25 is accomodated within the spring chamber 25*b* and exerts a spring force to the needle valve element 21 through a spring retainer 24 in the downward direction (orifice closing direction). The needle valve element 21 is applied with a fuel pressure in the opposite direction at the shoulder portion 26 located in the fuel chamber 27 and tends to move in the upward direction (orifice opening direction) under the pressure of fuel supplied from the fuel conduit 11 upon fuel injection. The pressure chamber 33 is communicated with a loading device 40 described hereinafter. When the pressure chamber 33 is pressurized through the loading device 40, the piston 30 and hence the needle valve element 21 are urged or displaced downwardly (in the orifice closing direction) in dependence on pressures exerted by the spring 25 against the fuel pressure applied to the shoulder portion 26 in the chamber 27 described above. Reference numeral 36 denotes a stopper which serves to limit the upward movement of the piston 30 in the orifice opening direction. According to one aspect of the invention, a loading device 40 is provided so as to supply under control a high pressure fuel to the pressure chamber 33 defined above the piston 30 attaining the termination of the fuel injection sharply or rapidly. The loading or pressurizing device 40 comprises a housing 41 in which first and second pressure control chambers 42 and 43 are formed with a partition wall 44 interposed therebetween. A constricted passage 45 is formed in the partition wall 44 so that the first and second pressure control chambers 42 and 43 may be communicated with each other. The first pressure control chamber 42 is communicated with the fuel feed conduit 11 through a first inducting conduit 46. A check valve 48 is located in the first pressure control chamber 42 under a pressure of a compression spring 47 so that the port at which the first inducting conduit 46 is connected to the first pressure control chamber 42 is usually closed. The first pressure control chamber 42 acts as a hydraulic accumulator for accumulating a high pressure fuel fed from the fuel feeding apparatus 100, if the accumulated fuel is of a relatively high pressure under which the fuel works as a compressive fluid. On the other hand, the second pressure control chamber 43 is constantly communicated with the fuel feed conduit 11 through a second fuel inducting conduit 49. A piston-like valve element 51 is slidably disposed within the second pressure control chamber 43 in a fluid-tight manner and serves to close usually the constricted passage 45 under the pressing force exerted by a compression spring 50 which is also accommodated within the second pressure chamber 43. Further, a port 52 which is communicated with the pressure chamber 33 of the injection nozzle valve device 20 through a conduit 53 is formed in the second pressure control chamber 43 in such a manner that the port 52 can be communicated with the second pressure control chamber 43 and hence with the first pressure control chamber 42 through the passage 45 when the valve element 51 usually closing both the port 52 and the communicating passage 45 is displaced downwardly against the force of the compression spring 50.

The pressure chamber 33 defined by the piston 30 of the nozzle valve device 20 is further provided with a fuel outlet port 55 which is communicated with a passage 56 formed in the cylinder block 31. The passage 56 in turn is connected to a fuel discharge conduit 58 having a constriction 57. It is to be noted that the inlet port 54 as well as the outlet port 55 are formed around the stopper projection 36 so that they can be communicated with the pressure chamber 33 even when the piston 30 about directly against the stopper 36.

With the above described arrangement of the fuel injection apparatus according to the invention, the fuel fed under a high pressure from the pressure feed device 100 during the upward stroke of the plunger 5 as described hereinbefore, will flow into the fuel chamber 27 of the injection nozzle valve device 20 by way of the fuel feed conduit 11 and the passage 28. Simultaneously, the fuel is also supplied to the first and the second pressure control chambers 42 and 43 of the loading or pressurizing device 40 through the respective fuel inducting passages 46 and 49. At that time, the check valve element 48 disposed in the first pressure chamber 42 of the loading device 40 is opened under the pressure of the inducted fuel against the spring 47. The needle valve element 21 is displaced upwardly against the force of the spring 25 under the pressure exerted onto the shoulder portion 26, whereby the injection orifices 23 are opened to inject the fuel into the associated cylinder of an internal combustion engine. In the meantime, the first and the second pressure control chambers 42 and 43 of the loading apparatus 40 are maintained at a same pressure. Thus, the valve element 51 is in the position to close both the constricted communication passage 45 and the inducting port 52 as is shown in the drawing. The pressure chamber 33 of the nozzle valve device 20 receives therefore no fuel supply. Besides, the fuel remaining in the pressure chamber 33 at the end of the preceding injection cycle can freely flow outwardly through the outlet port 55, passage 56 and the conduit 58. Under these conditions, the fuel pressure in the pressure chamber 33 dose not exert to the piston 30.

When the plunger 5 has been displaced to such a position where the notch 6 formed in the plunger 5 comes to overlap with the feed hole 7 formed in the cylinder 1, the fuel within the plunger chamber 8 will flow backwardly into a fuel supply means (not shown), thereby the fuel pressure in the chamber 8 is decreased, which in turn results in the reduced hydraulic pressure exerted on the shoulder portion 26 of the needle valve element 21 in the fuel chamber 27. Then, the needle valve element 21 tends to move downwardly in the orifice closing direction under the load of the compression spring 25. At the same time, the decreased fuel feed pressure in the conduit 11 will bring about a pressure reduction in the second pressure control chamber 43 which is always communicated with the conduit 11, while the first pressure control chamber 42 will remain at a high pressure by virture of the fact that the check valve 48 is closed upon the decreasing of pressure in the feed conduit 11. Consequently, the piston-like valve element 51 is subjected to the fuel pressure in the first chamber 42 which is effective initially by the cross-sectional area of the constricted passage 45. When the pressure exerted onto the valve element 51 from the first control chamber 42, overcoming a preset load value of the spring 50 plus the decreased fuel pressure within the second chamber 43, so that the valve element 51 will begin to move in the downward direction. The fluid pressure applied to the valve element 51 from the first control chamber 42, rapidly builts up the resulted force, once the valve element 51 moved from the partition wall 44, because the effective pressure area (top surface area) of the valve element 51 is increased abruptly. Thus, the downward movement of the valve element 51 is promoted thereby to open the port 52. At that time, the fuel in the first pressure control chamber 42 can flow into the pressure chamber 33 of the nozzle valve device 20 through the constricted passage 45, the upper portion of the second pressure control chamber 43, port 52 and the passage 53. The fuel flowing into the pressure chamber 33 of the nozzle valve device 20 will of course exert a hydraulic pressure onto the top surface of the piston 30 thereby to move more speedily the needle valve element 21 in the downward or orifice closing direction in cooperation with the loading spring 25. Since the discharge conduit 58 is provided with the constricted portion 57, the fuel can only progressively flow outwardly from the pressure chamber 33 through the outlet port 55. The dimension of such constriction is so selected that the pressure within the chamber 33 may become substantially equal to the atmospheric pressure at the beginning of the succeeding fuel injection cycle. Furthermore, since the pressure within the first pressure control chamber 42 of the loading device 40 is also progressively decreased as the fuel in supplied to the pressure chamber 33, the valve element 51 can resume the starting position shown in the drawing under the influence of the spring 50 and becomes ready for the next fuel injection cycle.

As hereinbefore described, the slanted lower edge **7*a* of the feed hole 7 is made to have the substantially same geometrical configuration as the leading edge portion 6*a* of the notch 6 according to the teaching of the invention. This arrangement permits that the open area of the feed hole 7 is abruptly increased when the leading edge portion 6*a* has just passed by the lower edge 7*a* of the feed hole 7 during the upward stroke of the plunger 5. Thus, the feed back of the fuel to the fuel supply means (not shown) from which the fuel has been introduced during the downward movement of the plunger 5 is immediately initiated with a large amount just after the leading edge 6*a* has passed by the lower edge 7*a*** of the feed hole 7, as the result of which the fuel pressure within the fuel conduit 11 and the fuel chamber 27 of the injection nozzle valve device 20 is abruptly reduced for a desirable rapid or sharp termination of the fuel injection, as compared with the conventional case in which the feed hole is of a circular configuration. Additionally, because the needle valve element 21 is subjected to both the loading force of the spring 25 and the fuel pressure exerted onto the piston 30 from the loading or pressurizing device 40, the fuel injection orifices can be instantly closed by the needle valve element 21. In this manner, the fuel injection is terminated in a moment with a sharp termination characteristic. The pressure within the fuel chamber 27 would tend to increase momentarily upon the speed closing of the injection orifices by the needle valve element 21. However, in reality, the pressure within the fuel chamber 27 is rapidly reduced due to the fact that the speedy feed-back flow of the fuel will take place through the plunger and cylinder assembly 5, 8. Accordingly, the tendency of the pressure to increase within the fuel chamber 27 as caused by the speedy downward movement of the needle valve element 21 is compensated by the pressure reduction caused by the fuel feed-back through the feed hole 7 without bringing about any appreciable fluctuations in the pressure in the chamber 27. In this connection, it should be noted that a large amount of fuel feed-back would possibly produce bubbles due to the rapid pressure reduction in the plunger chamber 8, while an increased load produced by the loading device 40 to accomplish a speedy valve closing operation would encounter a counter action of a momentarily increased fuel pressure exerted to the shoulder portion 26 of the needle valve element 21. However, it has been observed that the combination of these features in the above described manner is effective in suppressing possible pressure variation in the fuel chamber 27 at minimum.

Referring to FIG. 2 which illustrates graphically the pressure variations in the fuel chamber 27 of the nozzle valve device 20, curve A represents the pressure fluctuation which takes place when the fuel injection is to be terminated instantly only by means of the feed hole of a selected configuration. It has been observed, refering to FIG. 2, that bubbles or cavities are produced in the fuel within the plunger chamber 8 as indicated by the segment of curve A which corresponds to zero pressure. Curve B represents fuel pressure variations in the fuel chamber 27 in an arrangement in which the feed hole of a circular configuration is provided and the needle valve element is independently applied with a closing load. It can be seen that a pressure increase occurs in the fuel chamber 27. According to an aspect of the invention, combination is made therefore such that the tendency of the pressure increasing within the fuel chamber 27 due to the downward movement of the needle valve element 21 at the time of the injection orifice closing operation thereof, may be optionally compensated by a rapid pressure decreasement in the plunger chamber 8 by virtue of the provision of the feed hole 7 of the unique configuration and the loading or pressurizing device 40 of the structure described hereinbefore. In this case, a desirable pressure variation can be attained as represented by a curve C in FIG. 2.

Experiments have been conducted, results of which are graphically illustrated in FIG. 3. Curves D1 and D2 represent pressure variations in the nozzle valve device 20 and particularly in the fuel chamber 27 in the case of such arrangement, in which the nozzle orifice closing operation is effected by applying only the closing load from the loading means such as 25 and 40 onto the needle valve element 21, while the curves E1 and E2 represent the corresponding pressure variations occurring when the pressure reduction caused by the feed hole 7 of the specific geometry is utilized in combination with the nozzle valve closing load such as the spring 25 and the loading device 40. The characteristic curves D1 and E1 can be obtained in the case where a large load is applied to the needle valve element. On the other hand, the curves D2 and E2 represent the pressure variations under a relatively small closing load. It can be seen from these graphic illustrations that the fuel pressure within the fuel chamber 27 undergoes little variations or fluctuations at the termination of the fuel injection in the case of the combined arrangement according to the invention.

It is added at this point that the loading device 40 exerts no influence onto the needle valve element 21, when the nozzle valve device 20 is opened for the fuel injection. The opening pressure of the valve device 20 can be regulatably set at a desired value by adjusting the loading spring 25 as is in the case of the conventional apparatus.

FIG. 4 shows another embodiment of the nozzle valve device according to the invention. In the figure, like parts as those shown in FIG. 1 are denoted by the same reference numerals. In the case of this embodiment, the needle valve element 21 is connected to a spring seat 124 and operatively coupled to a piston 130 through a loading spring 125. The piston 130 is slidably disposed within a bore 132 formed in a housing block 131 and defines a pressure chamber 133 which is communicated with the loading device 40 such as shown in FIG. 1 through a conduit 54 as well as with the discharge conduit 58 shown in FIG. 1 through a corresponding outlet port 55. With this arrangement, substantially similar effect as that of the first embodiment shown in FIG. 1 can be attained. In other words, when the injection orifices are to be closed by the needle valve element 21 at the termination of fuel injection, fuel is supplied to the pressure chamber 133. Thus, a sum of the pressure of the load spring 125 and the pressure within the chamber 133 is applied to the needle valve element 21 thereby to speed up the closing operation without incurring any appreciable pressure variation in the fuel chamber 27 due to the arrangement that the chamber 27 is connected to the loading device 40 and the fuel pressure-feed apparatus 100 through the passage 28 in the same manner as is in the case of the first embodiment described hereinbefore. Numeral 35 denotes the fuel escape passage.

FIG. 5 shows a third embodiment of the nozzle injection valve device of a modified structure according to another aspect of the invention. In this figure, the parts common to those of the above described embodiments are denoted by the same numerals. The needle valve element 21 has a piston 230 secured thereto, which is slidably disposed within a bore 32 formed in an interposed block 31 as is in the case of the first embodiment shown in FIG. 1. The piston 230 divides the bore 32 into a first pressure chamber 233 located above and a second pressure chamber 234 located below the piston. The first pressure chamber 233 is connected to the fuel feed conduit 11 through a conduit 239 provided with a check valve 241 which is usually closed under a pressing load exerted by a compression spring 240. On the other hand, the second pressure chamber 234 is always communicated through a conduit 242 with the first pressure control chamber 42 of the loading device 40 which is of the substantially same structure as the one shown in FIG. 1 except for the conduit connection arrangement. The first and the second pressure chambers 233 and 234 of the injection nozzle device 20 are communicated with each other through a constricted passage 243 formed in the piston 230. The loading device 40 is provided with a fuel escape port 244 which is usually closed by the slidable piston-like valve element 51 under the force of the compression spring 50 and is opened into the second pressure chamber 43 when the valve element 51 is displaced downwardly against the spring 50.

With the arrangement shown in FIG. 5 and described above, when the fuel pressure within the fuel feed conduit 11 increases upon the fuel injection through the upward movement of the piston in the fuel pressure-feeding device, the fuel under a high pressure will flow into the first pressure chamber 233 located above the piston 230 through the passage 239 against the counter force of the spring 240 of the check valve 241. At the same time, the check valve 48 of the loading device 40 is opened, as described hereinbefore in connection with the first embodiment shown in FIG. 1. As the result, the fuel will flow into the first control chamber 42 of the loading device and hence into the second pressure chamber 234 located below the piston 230 through the conduit 242. Additionally, the fuel flow into the second control chamber 43 of the loading device 40, so that both chambers 42 and 43 are filled with the fuel at a high pressure. When the fuel pressure is reduced at the termination of the fuel injection in the manner described hereinbefore in connection with the pressure feed device 100 shown in FIG. 1, the check valves 48 and 241 are closed again, while the valve element 51 disposed within the second pressure control chamber 43 of the loading device 40 is opened, whereby the fuel within the second pressure chamber 234 below the piston 230 will flow through the passage 242, the first pressure control chamber 42 and the constricted passage 45 into the second pressure control chamber 43 of the loading device 40 and hence to the opened escape port 244. Thus, the piston 230 is subjected to the fuel pressure within the first pressure chamber 233 and the needle valve element 21 is thereby rapidly moved downwardly to close the injection orifices and terminates instantly the fuel injection. The fuel within the first pressure chamber 233 defined above the piston 230 will then flow into the second pressure chamber 234 progressively through the constricted passage 243. Reference numeral 235 denotes an discharge conduit for the leaked fuel.

From the foregoing description, it will be appreciated that the fuel injection nozzle valve devices 20 with the loading devices 40 of the structure constructed according to the teaching of the invention can assure a sharp or rapid termination of the fuel injection by utilizing the fuel pressure itself in combination with the valve load spring thereby to move the needle valve element of the injection nozzle valve device more speedily to the nozzle orifice closing position at the termination of the fuel injection cycle. The fuel injection valve device with the loading means 40 according to the invention can be by itself used with a conventional fuel pressure-feeding apparatus with an improved fuel injection performance. However, when the device is employed in combination with the pressure-feeding apparatus having a feed plunger formed with a notch having a slanted leading edge and the corresponding feed hole formed in the cylinder wall such as shown in FIG. 1, an excellent fuel injection termination characteristic can be obtained as described hereinbefore in conjunction with FIGS. 2 and 3.

Although the invention has been described by taking example of preferred embodiments illustrated in the drawings, the invention is never restricted to them, but many variations and modifications will easily occur for those skilled in the art without departing from the spirit and scope of the invention.

What is claimed is:

1. A fuel injection apparatus for a internal combustion engine including means for intermittently feeding a fuel under a high pressure and a fuel injection valve apparatus for intermittently injecting the high pressure fuel into an associated combustion chamber of said internal combustion engine, wherein said fuel injection valve apparatus comprises:

(a) a valve housing communicated with said feeding means and formed with at least one injection orifice, (b) a needle valve element, slidably fitted in said valve housing, for opening and closing said injection orifice, said needle valve element being actuated by the high pressure fuel fed from said feeding means thereby to open said injection orifice for injecting the high pressure fuel, (c) means, operatively coupled to said needle valve element, biasing said element to close said injection orifice so that said needle valve element closes said injection orifice when the feed of the high pressure fuel from said feeding means is intermitted, and (d) means, operatively coupled to said needle valve element, for hydraulically thrusting said needle valve element in the orifice closing direction in cooperation with said biasing means, said thrusting means including means for accumulating the high pressure fuel fed from said feeding means so that the accumulated fuel thrusts said needle valve element in the closing direction when the needle valve element tends to close said injection orifice.

2. A fuel injection apparatus as set forth in claim 1, said feeding means comprising:

(a) a cylinder formed with a feed hole, (b) a plunger reciprocally disposed within said cylinder so as to vary a volume of a plunger chamber defined by said cylinder and said plunger, thereby the fuel is introduced into said plunger chamber through said feed hole when said volume is incleased by a corresponding movement of said plunger, while said fuel is compressed to increase the fuel pressure when said plunger is moved in the opposite direction after closing said feed hole, said plunger being formed with a notch having a leading edge and opened in said plunger chamber at such a position that said feed hole may again communicate with said plunger chamber through said notch when said notch is aligned with said feed hole thereby to decrease the fuel pressure in said plunger chamber at the end of the movement of said plunger in said opposite direction, (c) a discharge valve communicated to said plunger chamber and adapted to discharge said high pressure fuel when the fuel pressure in said plunger chamber increases beyond a preselected value, and (d) a fuel feeding conduit communicated with said discharge valve to supply the fuel under high pressure therefrom to said fuel injection valve apparatus, whereby the fuel is intermittently pressurized and fed to said fuel injection valve apparatus through said feeding conduit in synchronism with the reciprocating movement of said plunger.

3. A fuel injection apparatus as set forth in claim 2, wherein said feed hole has an edge which first comes into alignment with the leading edge of said notch formed in said plunger, said edge of said feed hole being of the substantially same geometrical configuration as that of said leading edge of said notch so that the opened aperture area of said feed hole may be increased abruptly at the begining of the alignment between said notch and said feed hole at the end of the pressurizing movement of said plunger.

4. A fuel injection apparatus as set forth in claim 3, wherein said feed hole is of a rectangular shape and said leading edge of said notch extends in a straight line.

5. A fuel injection apparatus for an internal combustion engine including means for intermittently feeding the fuel under a high pressure, and a fuel injection valve apparatus communicated with said feeding means, for receiving the high pressure fuel supplied from said feeding means thereby to inject the high pressure fuel into an associated combustion chamber of said internal combustion engine, said fuel injection valve apparatus comprising;

(a) a valve housing having a fuel passage communicated to said feeding means and at least one injection orifice communicated with said fuel passage, (b) a needle valve element, reciprocally fitted in said valve housing, for opening and closing said injection orifice, through the reciprocating movement thereof, said needle valve element having a portion located in said fuel passage and adapted to be applied with the pressure of the high pressure high fed through said fuel passage so as to open said injection orifice, (c) means, operatively coupled to said needle valve element, for biasing said valve element to close said injection orifice, whereby said injection orifice is opened to inject therethrough the fuel into said combustion chamber when said pressure of the high pressure fuel applied to said portion of the needle valve element overcomes the load exerted by said biasing means, and (d) means, operatively coupled to said needle valve element, and adapted to respond to the pressure of the high pressure fuel fed from said feeding means, for hydraulically thrusitng said needle valve element in the direction of closing said injection orifice when the pressure of the fuel is reduced, said thrusting means including means for accumulating the high pressure fuel fed from said feeding means so that the accumulated fuel thrusts said needle valve element in the closing direction when the needle valve element tends to close said injection orifice.

6. A fuel injection apparatus as set forth in claim 5, wherein said needle valve element is formed with a shoulder portion located in a fuel chamber formed in said fuel passage and adapted to move under the fuel pressure applied thereto from said feeding means in the direction of closing said injection orifice against the force of said biasing means.

7. A fuel injection apparatus as set forth in claim 5, said feeding means comprising:

(a) a cylinder formed with a feed hole, (b) a plunger reciprocally disposed within said cylinder so as to vary a volume of a plunger chamber defined by said cylinder and said plunger, wherein the fuel is introduced into said plunger chamber when said volume is increased by a corresponding movement of said plunger, while said fuel is compressed to increase the fuel pressure when said plunger is moved in the opposite direction to close said feed hole, said plunger being formed with a notch having a leading edge and opened in said plunger chamber at such a position that said feed hole may again communicate with said plunger chamber through said notch when said notch is aligned with said feed hole thereby to decrease the fuel pressure within said plunger chamber at the end of the movement of said plunger in said opposite direction.

(c) a discharge valve communicated to said plunger chamber and adapted to discharge said high pressure fuel when the pressure of fuel within said plunger chamber increases beyond a preselected value, and (d) a fuel feeding conduit, communicated with said discharge valve, for supplying the high pressure fuel to said fuel injection valve apparatus, whereby the fuel is intermittently pressurized and fed to said fuel injection valve apparatus through said feeding conduit in synchronism with the reciprocating movement of said plunger.

8. A fuel injection apparatus as set forth in claim 7, wherein said feed hole has an edge which first comes into alignment with the leading edge of said notch formed in said plunger, said edge of said feed hole being of the substantially same geometrical configuration as that of said leading edge of said notch so that the opened aperture area of said feed hole may be increased abruptly at the beginning of the alignment between said notch and said feed hole at the end of the pressurizing movement of said plunger in said opposite direction.

9. A fuel injection apparatus as set forth in claim 5, wherein said thrusting means comprises a first piston hydraulically coupled to said needle valve element in such a manner that movement of said first piston in one direction causes movement of said needle valve element in the direction of closing said injection orifice, said first piston being moved by said accumulating means of said thrusting means in said one direction in response to reduction in the pressure of fuel fed from said feeding means.

10. A fuel injection apparatus as set forth in claim 9, wherein said accumulating means comprises means for storing therein the high pressure fuel fed from said feeding means, and means for discharging said stored fuel to exert the fuel pressure to said piston thereby to move the latter in said one direction.

11. A fuel injection apparatus as set forth in claim 10, wherein said needle valve element includes a second piston slidably disposed within a pressure chamber formed in said valve housing and is adapted to receive the fuel from said discharging means and move in the injection orifice closing direction under the pressure exerted onto said second piston by the fuel discharged from said discharging means.

12. A fuel injection apparatus as set forth in claim 11, wherein said second piston is located between said needle valve element and said biasing means composed of a spring which constantly urges said needle valve element toward the injection orifice closing position.

13. A fuel injection apparatus as set forth in claim 11, wherein said biasing means composed of a spring is located between said second piston and said needle valve element.

14. A fuel injection apparatus as set forth in claim 11, wherein said pressure chamber is communicated through a conduit with a first pressure control chamber in which said first piston is disposed, said conduit being adapted to be closed by said first piston under the pressure of fuel supplied to said first pressure control chamber at the beginning of the fuel injection cycle.

15. A fuel injection apparatus as set forth in claim 14, wherein said first pressure control chamber is communicated through a passage with a second pressure control chamber which is communicated with said feeding conduit and accommodates therein a check valve at the inlet port of said conduit, so that fuel supplied from said conduit is stored in said second pressure control chamber, wherein, upon termination of the feeding, said first piston in said first pressure control chabmer is displaced under the pressure of fuel discharged from said second pressure control chamber through said passage thereby to open said conduit for supplying the fuel stored in said second control chamber to said pressure chamber.

16. A fuel injection apparatus as set forth in claim 11, wherein said second piston defines first and second pressure chambers, and said first pressure chamber is communicated with said fuel feeding conduit through a check valve to prevent the fuel flow from said first pressure chamber to said conduit, while said second pressure chamber is communicated with a second pressure control chamber communicated with said fuel feeding conduit and accommodates therein a check valve for allowing only the fuel flow into said second pressure control chamber which is turn is communicated with a first pressure control chamber through a passage which is closed by said first position under the pressure of fuel fed to said second pressure control chamber so that upon termination of the feeding, said first pressure chamber is subjected to a high pressure while the fuel pressure within said second pressure chamber is decreased thereby to move said needle valve element toward the orifice closing position.

* * * * *